US011567456B2

(12) United States Patent
Di Domenico et al.

(10) Patent No.: US 11,567,456 B2
(45) Date of Patent: Jan. 31, 2023

(54) OPTIMISED MAGNETO-MECHANICAL TIMEPIECE ESCAPEMENT MECHANISM

(71) Applicant: The Swatch Group Research and Development Ltd, Marin (CH)

(72) Inventors: Gianni Di Domenico, Neuchatel (CH); Jerome Favre, Neuchatel (CH); Dominique Lechot, Les Reussilles (CH); Baptiste Hinaux, Lausanne (CH); Olivier Matthey, Mauborget (CH); Pascal Winkler, St-Blaise (CH); Marc Stranczl, Nyon (CH); Michel Willemin, Preles (CH); Ahmad Odeh, Renens (CH)

(73) Assignee: The Swatch Group Research and Development Ltd, Marin (CH)

( * ) Notice: Subject to any disclaimer, the term of this patent is extended or adjusted under 35 U.S.C. 154(b) by 807 days.

(21) Appl. No.: 16/571,428

(22) Filed: Sep. 16, 2019

(65) Prior Publication Data

US 2020/0089168 A1 Mar. 19, 2020

(30) Foreign Application Priority Data

Sep. 19, 2018 (EP) ..... 18195530

(51) Int. Cl.

| | |
|---|---|
| ***G04C 5/00*** | (2006.01) |
| ***G04B 15/04*** | (2006.01) |
| ***G04C 3/04*** | (2006.01) |

(52) U.S. Cl.

CPC ..... *G04C 5/005* (2013.01); *G04B 15/04* (2013.01); *G04C 3/04* (2013.01)

(58) Field of Classification Search

CPC ..... G04C 5/005; G04C 3/04; G04B 15/04

See application file for complete search history.

(56) References Cited

U.S. PATENT DOCUMENTS 2,571,085 A 10/1951 Clifford
3,183,426 A 5/1965 Haydon
(Continued)

FOREIGN PATENT DOCUMENTS

CN 101091141 A 12/2007
CN 106062643 A 10/2016
(Continued)

OTHER PUBLICATIONS

European Search report dated May 20, 2019 in European Application 18195530.3, filed on Sep. 19, 2018 (with English Translation of Categories of Cited Documents)
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

An oscillator includes a resonator, which has an inertial mass returned by an elastic return and carries entry and exit pallets cooperating with teeth of an escape wheel each provided with a magnet. Each pallet includes a magnetic arrangement, with an annular sector, centred on the axis of oscillation of the resonator, defining a first magnetic barrier area extending above and/or below a mechanical pallet-stone of the entry pallet or exit pallet, over the entire length of this mechanical pallet-stone acting as support for the teeth during the supplementary arc, in order to form a magnetic cylinder escapement mechanism.

18 Claims, 9 Drawing Sheets

(56) References Cited

U.S. PATENT DOCUMENTS

| | | | | |
|---|---|---|---|---|
| 3,673,792 | A | 7/1972 | Scholz | |
| 2007/0201317 | A1* | 8/2007 | Houlon | G04C 5/005 368/281 |
| 2016/0357149 | A1* | 12/2016 | Stranczl | G04B 15/08 |

FOREIGN PATENT DOCUMENTS

| | | | |
|---|---|---|---|
| CN | 107092179 | A | 8/2017 |
| CN | 108241281 | A | 7/2018 |
| DE | 1 253 172 | B | 10/1967 |
| EP | 2 894 522 | A2 | 7/2015 |
| EP | 3 128 380 | A1 | 2/2017 |
| GB | 1096039 | A | 12/1967 |
| JP | 49-100567 | U | 8/1974 |

OTHER PUBLICATIONS

Combined Chinese Office Action and Search Report dated Nov. 4, 2020 in corresponding Chinese Patent Application No. 201910884458.0 (with English Translation of Category of Cited Documents), 7 pages.

Japanese Office Action dated Aug. 4, 2020 in Patent Application No. 2019-165896 (with English translation), 9 pages.

* cited by examiner

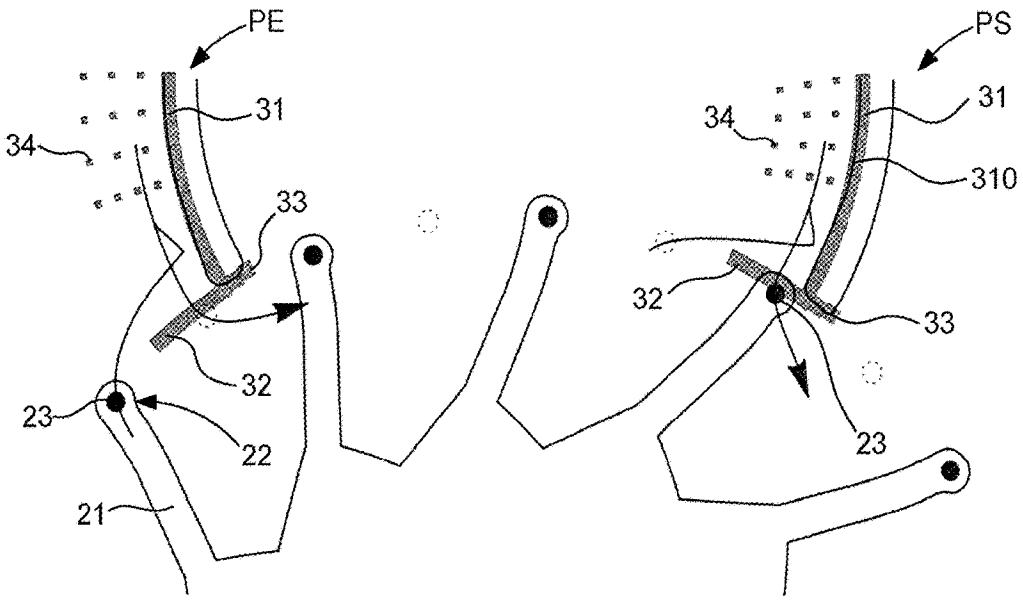
Fig. 17
Fig. 18
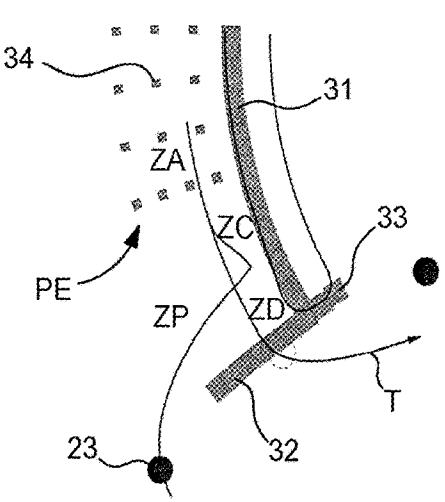
Fig. 19
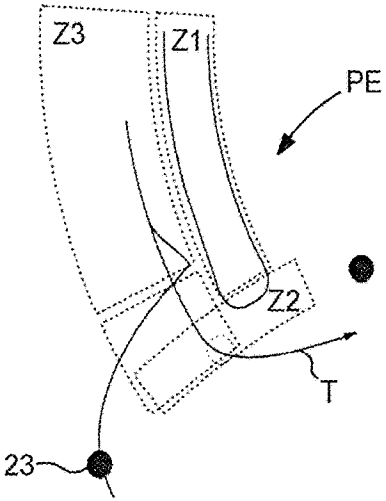

OPTIMISED MAGNETO-MECHANICAL TIMEPIECE ESCAPEMENT MECHANISM

CROSS-REFERENCE TO RELATED APPLICATION

The present application claims priority to European Patent Application No. 18195530.3, filed on Sep. 19, 2018, the entire content and disclosure of which are incorporated by reference herein.

FIELD OF THE INVENTION

The invention concerns a timepiece oscillator, including at least one resonator, with an inertial mass returned by elastic return means with respect to a fixed structure, said resonator oscillating about an axis of oscillation, said inertial mass carrying an entry pallet and an exit pallet, said oscillator comprising an escapement mechanism including an escape wheel, arranged to rotate about an axis of rotation and including end teeth, each arranged to cooperate with said entry pallet or with said exit pallet to maintain the oscillation of said resonator mechanism.

The invention also concerns a timepiece movement comprising at least one such oscillator.

The invention also concerns a watch including at least one such timepiece movement and/or at least one such oscillator.

The invention concerns the field of timepiece oscillator mechanisms.

BACKGROUND OF THE INVENTION

The use of flexure bearings makes it possible to make high frequency resonators having a high quality factor, as, for example, in European Patent Application Nos. EP2908184, EP2908185, EP30350126, EP3035127, in the name of THE SWATCH GROUP RESEARCH & DEVELOPMENT, EP2891929 in the name of NIVAROX-FAR, EP3054357 in the name of ETA, EP2911012 in the name of CSEM, EP3182214 in the name of AUDEMARS PIGUET and WO2017157870 in the name of LVMH.

Frictionless magnetic escapements are well suited to maintaining the oscillation of this type of resonator, as explained in Patent Application Nos. EP141999882.3 in the name of THE SWATCH GROUP RESEARCH & DEVELOPMENT, or U.S. Pat. No. 9,715,217 in the name of DI DOMENICO, since they make it possible to obtain high efficiency. The addition of a mechanical device preventing uncoupling of oscillation ensures robustness during wear, as in European Patent Application No. EP16195405.2 in the name of THE SWATCH GROUP RESEARCH & DEVELOPMENT, but it makes the self-starting function difficult.

European Patent No. EP2889704B1 in the name of NIVAROX-FAR discloses an escapement mechanism whose escape wheel, subjected to a pivoting torque of lower moment than a nominal moment, includes actuators regularly distributed over its periphery, each arranged to cooperate directly with at least a first track of a regulating wheel set, particularly a cylindrical track. Each actuator includes first magnetic arresting means forming a barrier and arranged to cooperate with this first track which is magnetically charged or ferromagnetic, to exert on the first track a torque of greater moment than the nominal moment. Each actuator further includes second arresting means arranged to form an end-of-travel stop, arranged to constitute an autonomous escapement mechanism with at least a first complementary stop surface comprised in the regulating wheel set.

A general proposition to combine a high efficiency magnetic escapement with a mechanical escapement with self-starting and safety features is disclosed in European Patent Application No. EP2894522 in the name of NIVAROX-FAR.

SUMMARY OF THE INVENTION

The invention proposes to make a robust and self-starting escapement mechanism for maintaining the oscillation of a high frequency, high quality factor resonator.

To this end, the invention concerns a timepiece oscillator mechanism according to claim 1.

The invention also concerns a timepiece movement comprising at least one such oscillator.

The invention also concerns a watch including at least one such timepiece movement and/or at least one such oscillator.

BRIEF DESCRIPTION OF THE DRAWINGS

Other features and advantages of the invention will appear upon reading the following detailed description, with reference to the annexed drawings, in which.

Figure 3:
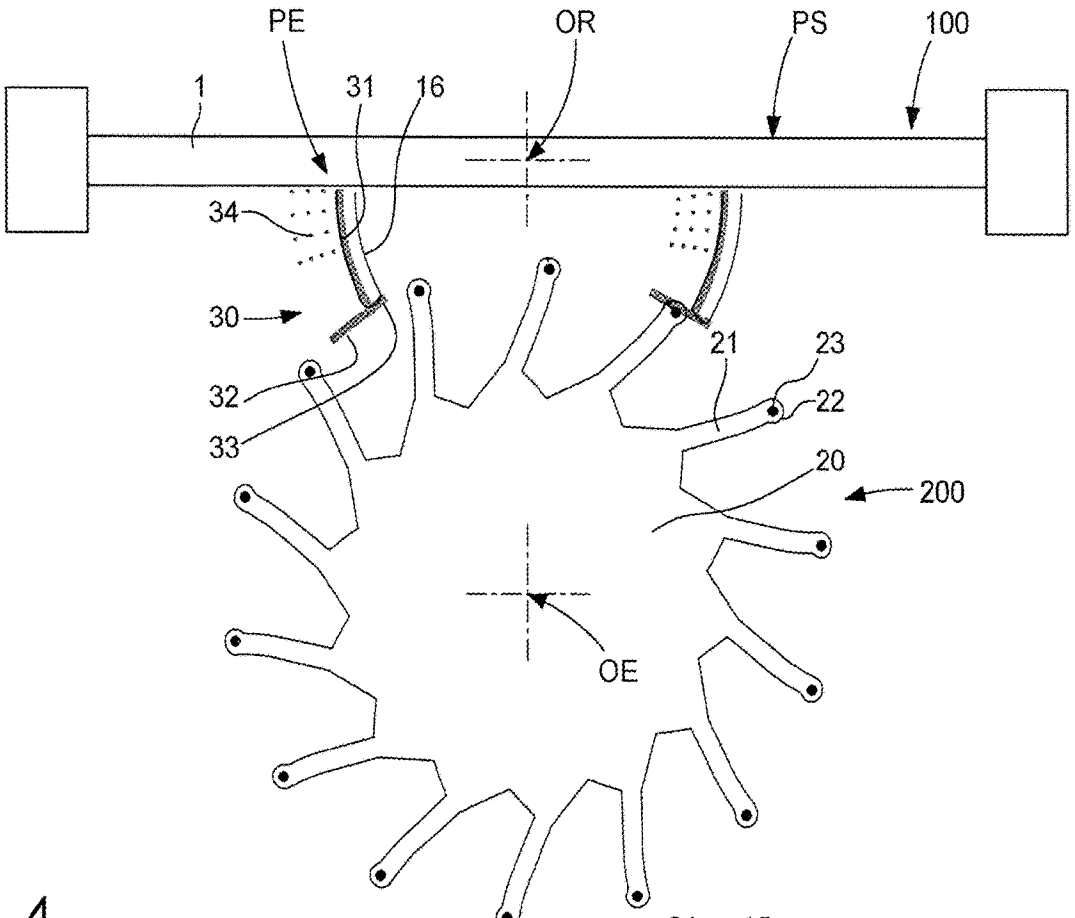
FIG. 3 represents, in a similar manner to FIG. 1, a particular geometry of the magneto-mechanical escapement mechanism according to the invention.
Figure 5:
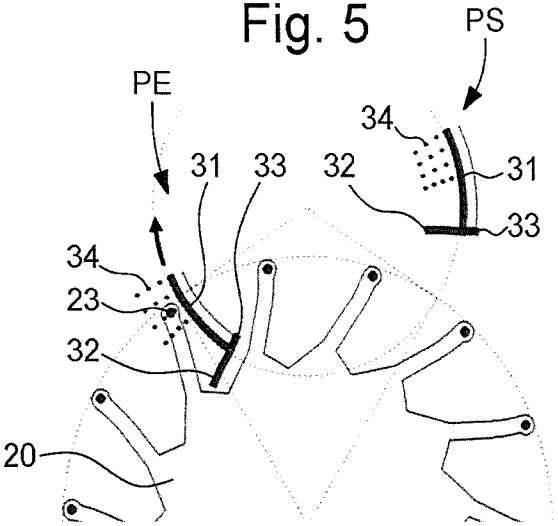
Figure 6:
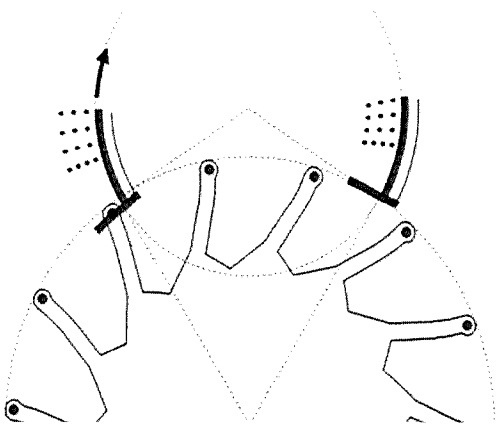
Figure 7:
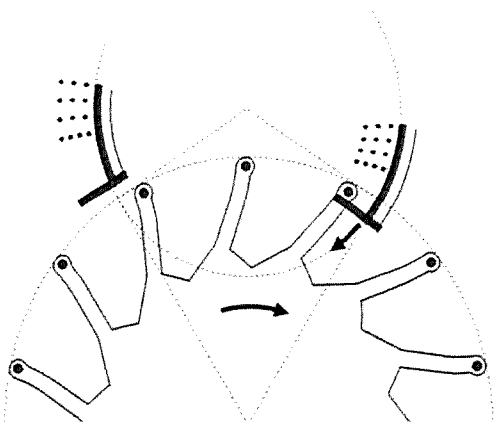
Figure 8:
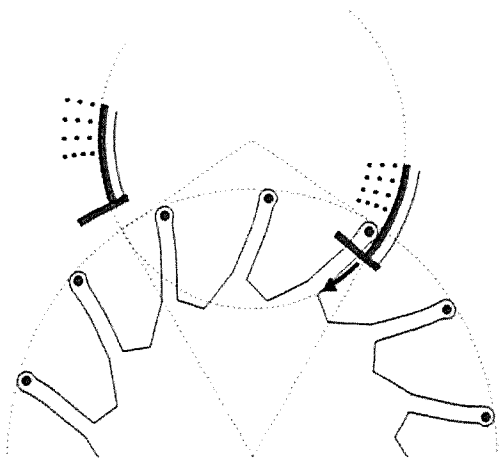
Figure 9:
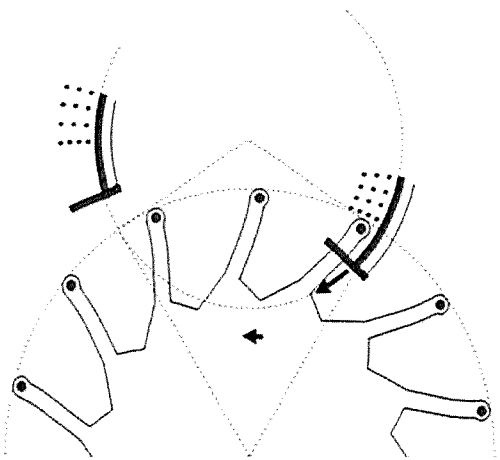
Figure 10:
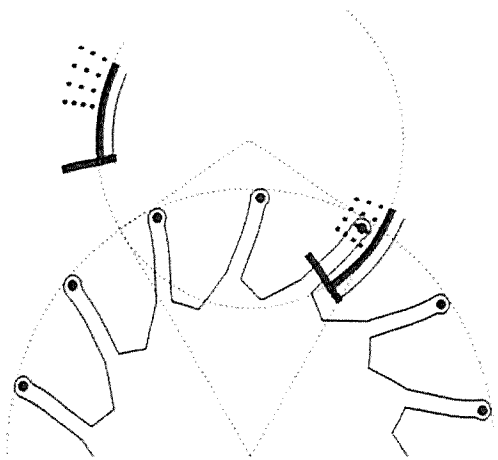
Figure 11:
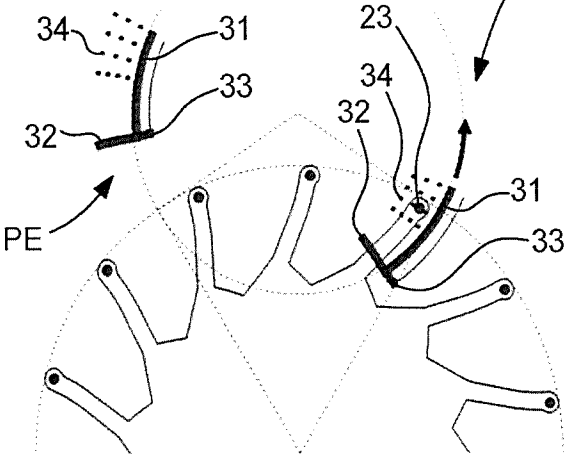
Figure 12:
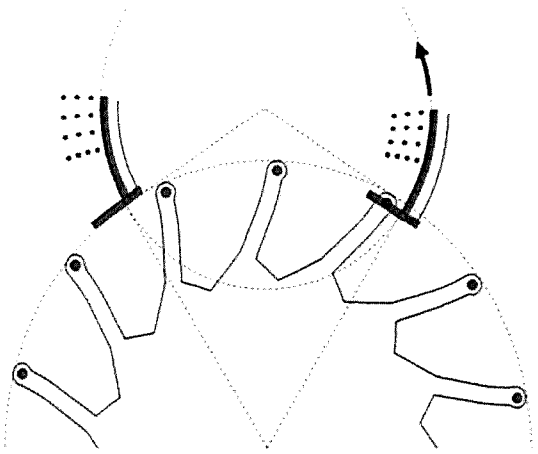
Figure 13:
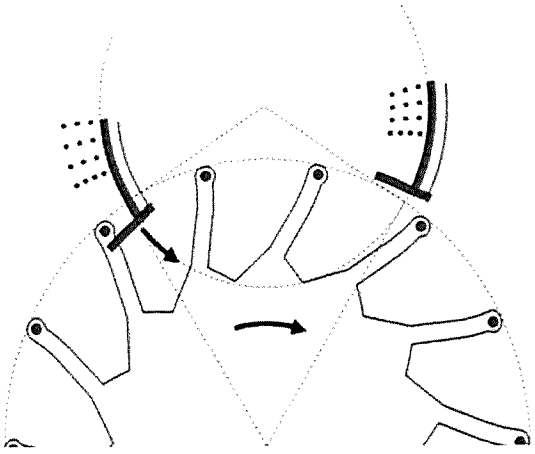
Figure 14:
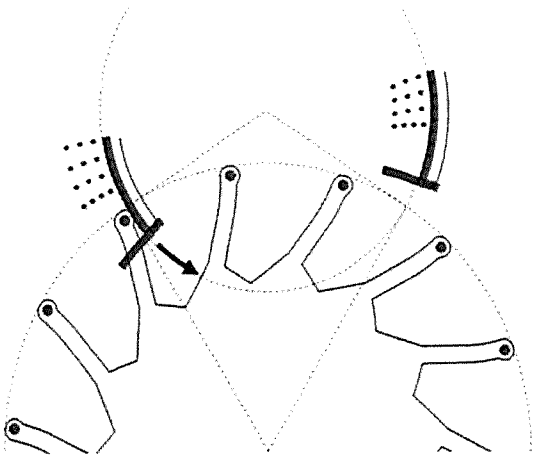
Figure 15:
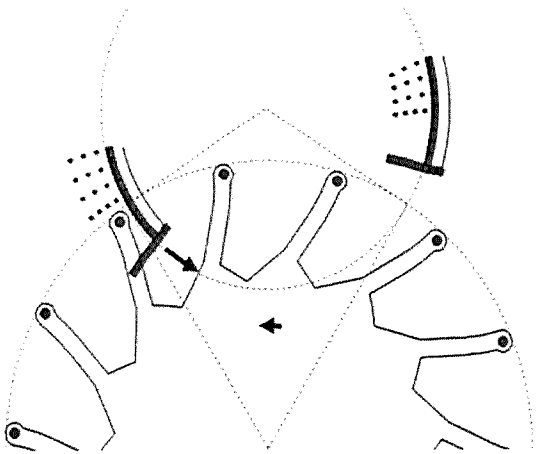
Figure 16:
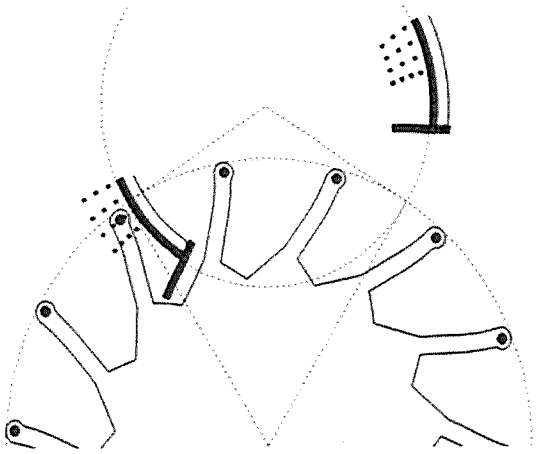

Each of FIGS. 5 to 10 discloses, in a similar manner to FIG. 3, a step in the sequence of operation of the escapement on the exit pallet:

FIG. 5: frictionless supplementary arc;

FIG. 6: unlocking on the entry pallet;

FIG. 7: advance of the escape wheel and impulse on the exit pallet;

FIG. 8: impact on the exit pallet;

FIG. 9: slight recoil of the escape wheel;

FIG. 10: frictionless supplementary arc;

Each of FIGS. 11 to 16 describes, in a similar manner to FIGS. 5 to 10, a step in the sequence of operation of the escapement on the entry pallet:

FIG. 11: frictionless supplementary arc;

FIG. 12: unlocking on the exit pallet;

FIG. 13: advance of the escape wheel and impulse on the entry pallet;

FIG. 14: impact on the entry pallet;

FIG. 15: slight recoil of the escape wheel;

FIG. 16: frictionless supplementary arc;

FIG. 17 represents, in a similar manner to FIG. 3, the trajectories of the escape wheel magnets in the resonator reference frame.

FIG. 18 represents, in a similar manner to FIG. 3, the mechanical functional areas of the magnetic entry pallet.

FIG. 19 represents, in a similar manner to FIG. 3, the mechanical functional areas of the magnetic entry pallet.

Figure 20:
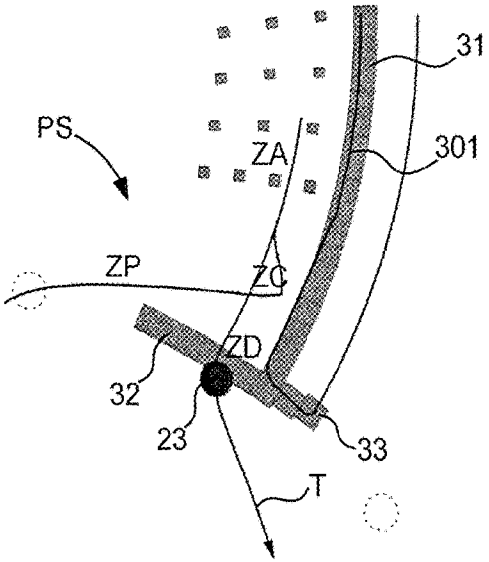

FIG. 20 represents, in a similar manner to FIG. 3, the mechanical functional areas of the magnetic exit pallet.

Figure 21:
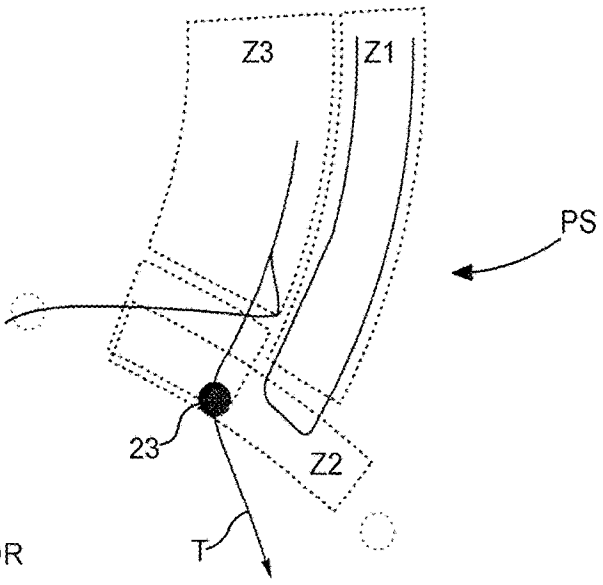

FIG. 21 represents, in a similar manner to FIG. 3, the mechanical functional areas of the magnetic exit pallet.

Figure 22:
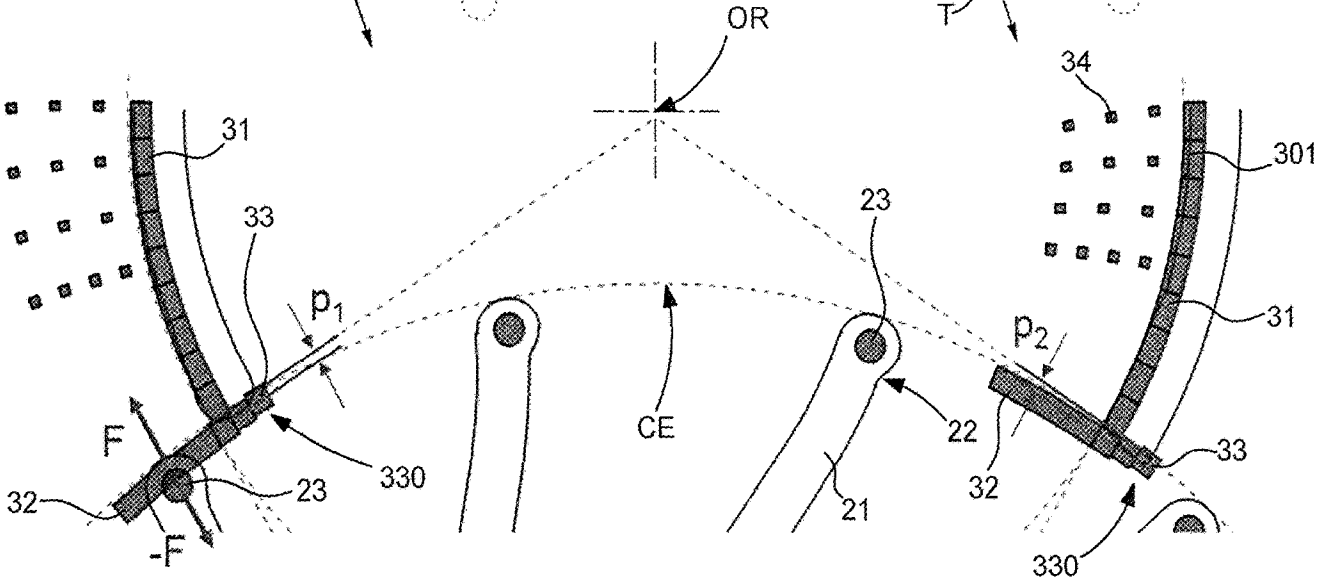

FIG. 22 represents, in a similar manner to FIG. 3, the safety features, depth, magnetic pads and self-starting function.

Figure 23:
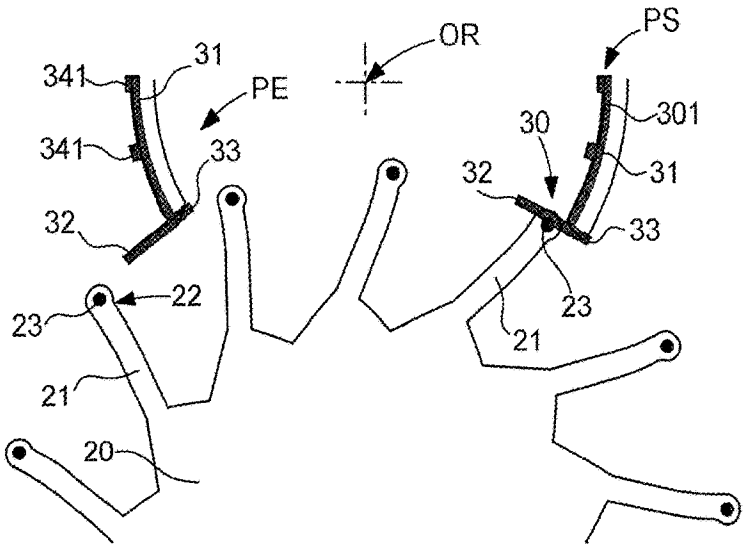

FIG. 23 represents, in a similar manner to FIG. 3, a variant of the isochronism corrector.

Figure 24:
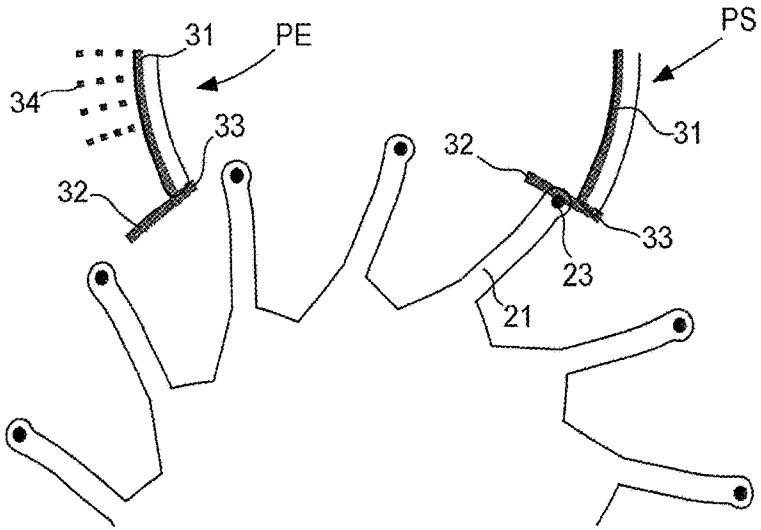

FIG. 24 represents, in a similar manner to FIG. 23, another variant of the isochronism corrector.

Figure 25:
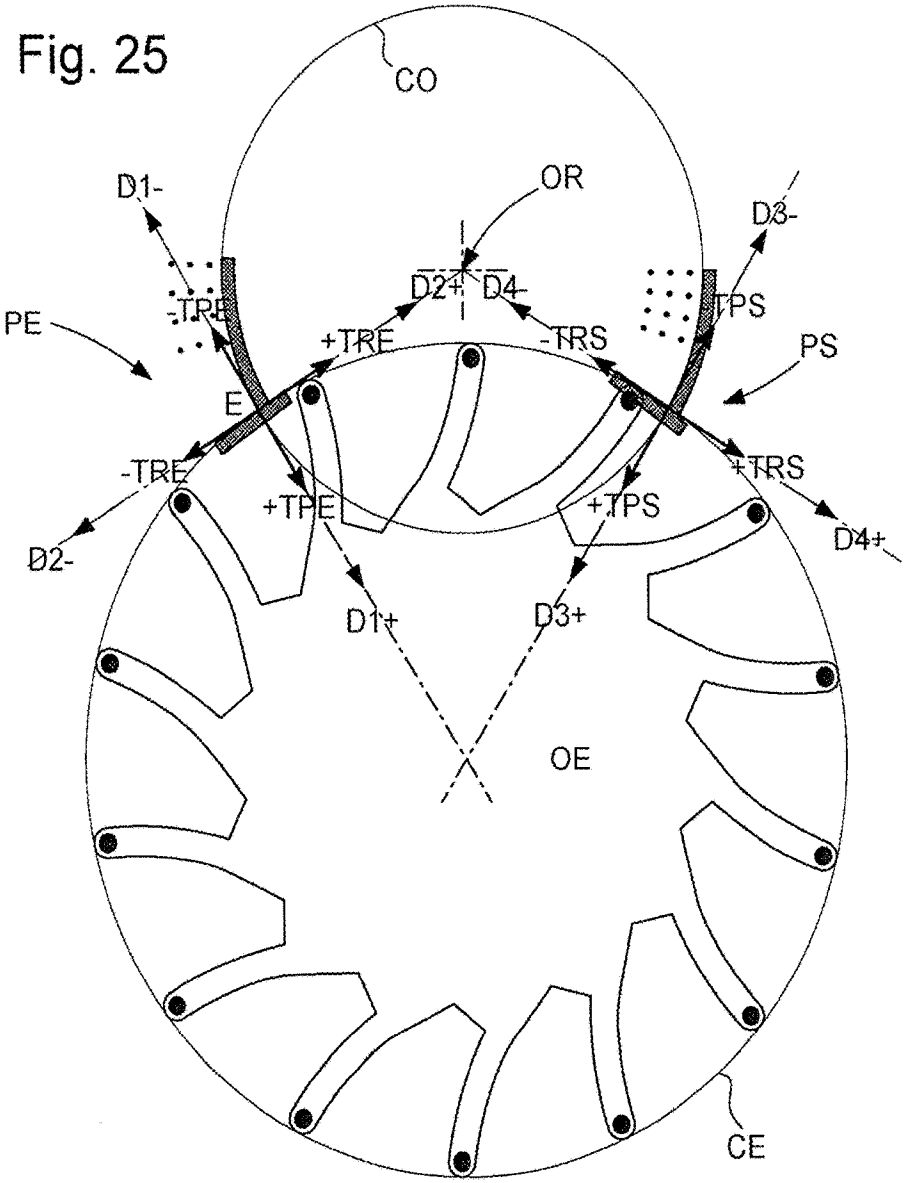

FIG. 25 is a schematic diagram which represents, in a similar manner to FIG. 3, a point of entry and a point of exit, which are defined by the intersections between a first circle centred on the axis of the resonator and which are followed by the magnetic barriers of the entry and exit pallets of the resonator, and a second envelope circle of the escape wheel centred on the escapement axis, at which entry and exit points the entry and exit pallets of the resonator are respectively traveled, and which shows the definition of basic directions oriented at tangents to this first circle and to this second circle, at this point of entry and at this point of exit.

Figure 26:
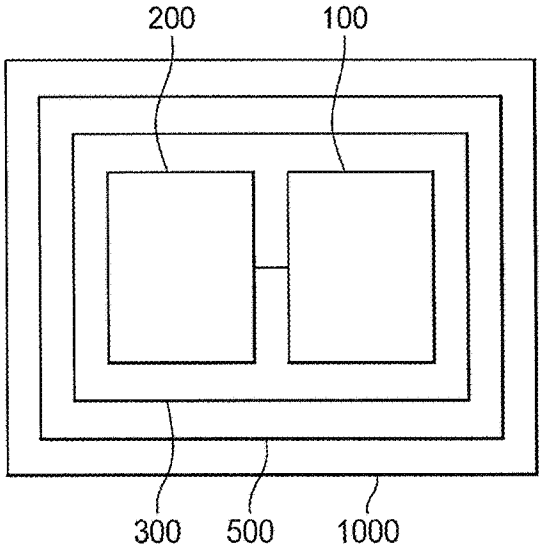

FIG. 26 is a block diagram representing a watch including a movement comprising an oscillator with a balance having flexible strips whose oscillation is maintained by a magneto-mechanical escapement according to the invention.

DETAILED DESCRIPTION OF PREFERRED EMBODIMENTS

The invention proposes to make a robust and self-starting escapement mechanism for maintaining the oscillation of a high frequency and high quality factor resonator, with features preventing uncoupling of oscillation.

The invention is a practical application of the magneto-mechanical escapement, like that described in European Patent Application No. EP2894522 in the name of NIVAROX-FAR, which combines the advantages of high efficiency, great robustness and self-starting.

As in European Patent No. EP2889704B1 in the name of NIVAROX-FAR, the invention adapts, with considerably improved efficiency, the principle of mechanical cylinder escapements, which have the advantage of ensuring safety in case of excessive torque, notably following a shock, but whose high friction level significantly impairs the efficiency of the escapement. The improvement in efficiency results from the elimination of the contact and friction in a cylinder escapement, by arranging magnets, or electrets, or suchlike, which, when carefully placed, form a magnetic or electrostatic repulsion, which eliminates friction and thus the main flaw of this mechanical cylinder escapement. The magnets, or suchlike, placed on the escape wheel, act as contactless stop members. Mechanical stop members are added to prevent the escape wheel racing in the event of shock.

The invention is more particularly described in the magnetic alternative. Those skilled in the art will find in the aforecited prior art the means for adapting the invention to an electrostatic version, or mixed magnetic/electrostatic version.

Figure 1:
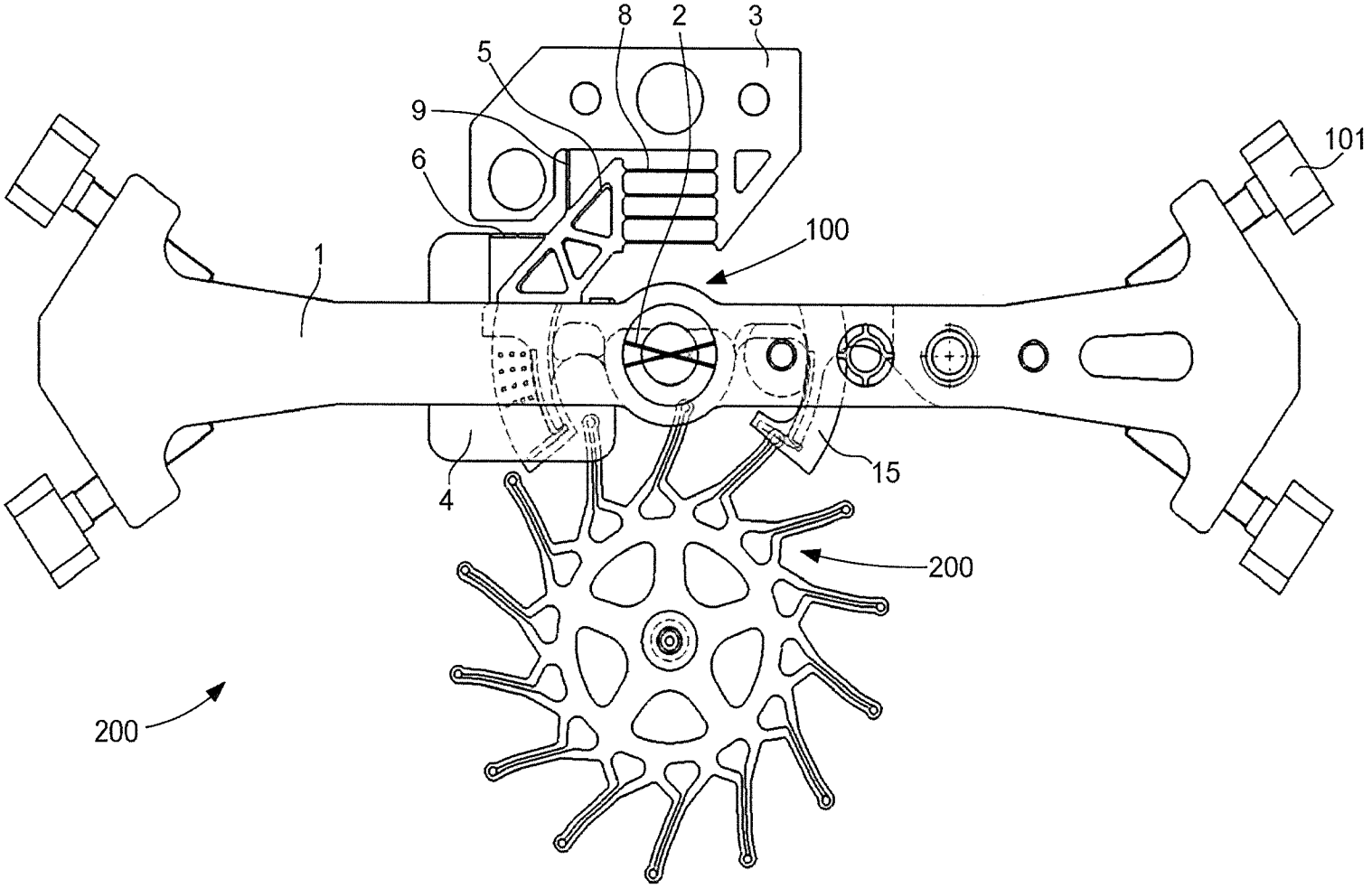
FIG. 1 represents a schematic top view of an oscillator which includes a balance with flexible strips maintained by a magneto-mechanical escapement.
Figure 2:
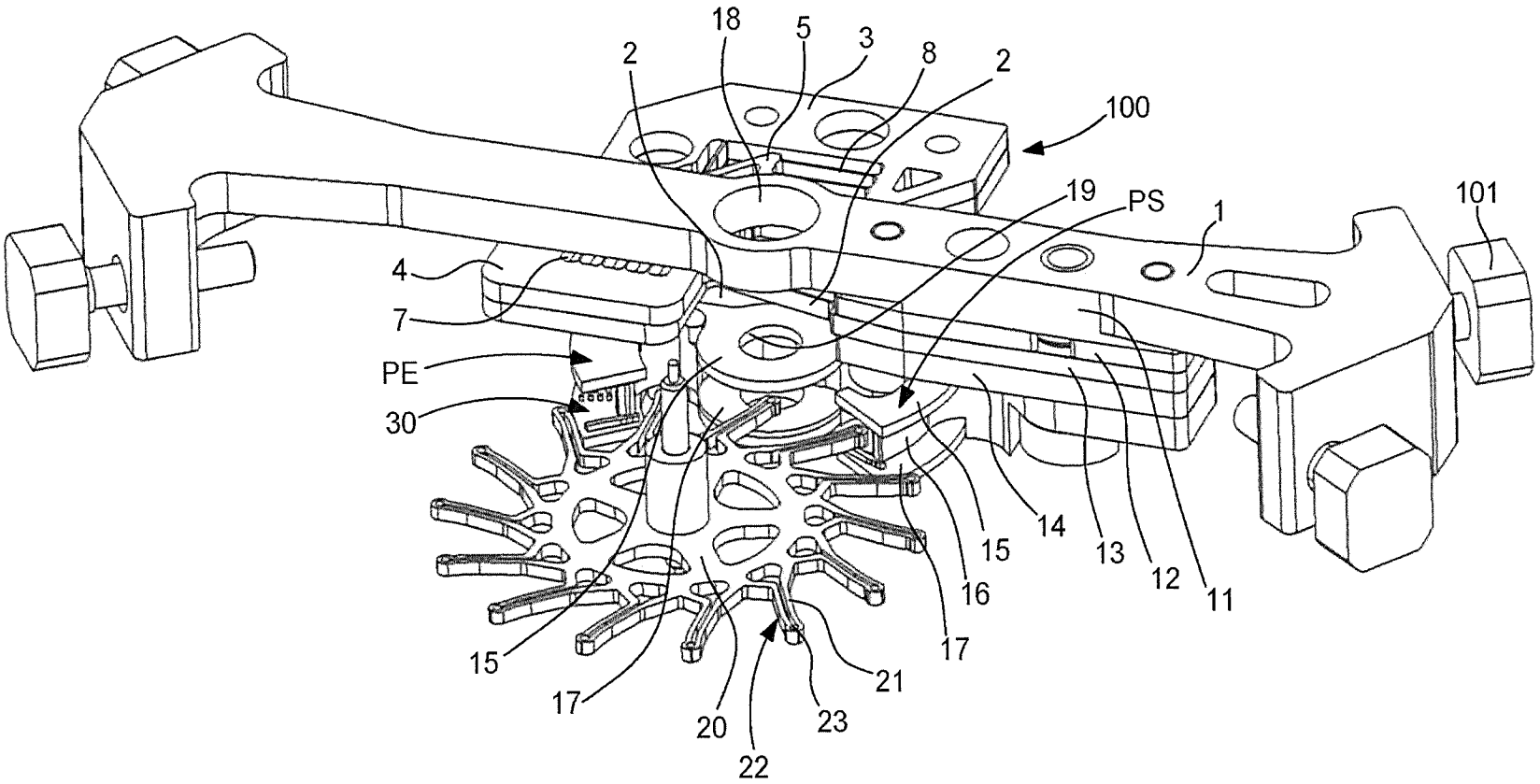
FIG. 2 represents a schematic, perspective view of the oscillator of FIG. 1.

The complete oscillator 300 includes at least one resonator 100, in particular but not limited to a resonator with at least one inertial mass 1, particularly a balance, directly or indirectly suspended from a fixed structure 3, which is intended to be fixed to a plate or suchlike. This at least one inertial mass 1 is return by elastic return means. In a particular embodiment, these elastic return means include flexible strips 2, as seen in FIGS. 1 and 2, and the oscillation of resonator 100 is maintained by a magneto-mechanical escapement mechanism 200. In other non-illustrated variants, these elastic return means may include at least one balance spring, or otherwise.

At least one inertial mass 1 carries an entry pallet PE and an exit pallet PS.

Oscillator 300 includes an escapement mechanism 200. Escapement mechanism 200 is an intermittently operating mechanism and includes, in a conventional manner, at least one escape wheel 20, arranged to rotate about an axis of rotation OE, and which includes arms 21 provided with mechanical end teeth 22, arranged to interact alternately with entry and exit pallets PE and PS. Each of these teeth 22 is arranged to cooperate with entry pallet PE or with exit pallet PS to maintain the oscillation of resonator 100.

According to the invention, this escapement mechanism 200 is a magneto-mechanical escapement. Escape wheel 20 includes at least one magnet 23 at the end of each tooth 22. These teeth 22 are arranged to rest on a mechanical pallet-stone 16, comprised in each entry pallet PE or exit pallet PS during the supplementary arc of resonator 100. Entry pallet PE includes a first magnetic arrangement 30 and exit pallet PS includes a second magnetic arrangement 30. This first magnetic arrangement 30 and this second magnetic arrangement 30 each include an annular sector, centred on axis of oscillation OR of resonator 100 and defining a first magnetic barrier area Z1. This first magnetic barrier area Z1 extends above and/or below mechanical pallet-stone 16, with reference to the direction of axis of oscillation OR, over the entire length of this mechanical pallet-stone able to act as support for teeth 22 during the supplementary arc, in order to form a magnetic cylinder escapement mechanism.

In the particular and non-limiting variant illustrated, such an inertial mass 1 comprises a balance 11, particularly made of titanium alloy, including inertia blocks 101. This inertial mass 1 is secured to two plates 12, 13, made of silicon or silicon and silicon dioxide, or similar, each including a flexible strip 2. The two flexible strips 2 represented here cross in projection substantially on axis of oscillation OR of inertial mass 1. The ends of the two plates, opposite to those fixed to balance 11, form a single mass 4, or two distinct masses 4, each suspended by transverse flexible strips 7 and/or at least one rigid beam 6 to an intermediate body 5, which is itself suspended to fixed structure 3 by longitudinal flexible strips 8 and/or at least one rigid beam 9. This particular arrangement forms an effective anti-shock table for protecting the flexure pivot formed by flexible strips 2.

Such anti-shock devices intended to protect the resonator strips are described, in particular, in Swiss Patent Application Nos. CH00518/18 in the name of ETA and CH00540/18 in the name of THE SWATCH GROUP RESEARCH & DEVELOPMENT. Advantageously, these devices include translation tables, which allow inertial mass 1 of resonator 100, particularly a balance 11, to move in case of shock, and stop members centred on the axis of rotation of this inertial mass, to retain said mass without acting on the strips of the pivot. These stop members are not visible in the Figures, and may consist of pins attached to a plate or to a bar, one being an upper pin engaging with play with an upper bore 18 in inertial mass 1, and limiting its displacement in case of shock, and the other being a lower pin engaging with play with a lower bore 19 in inertial mass 1, and limiting its displacement in case of shock. In FIG. 2, this bore 19 passes both through an upper flange 15 and a lower flange 17, which surround a mechanical pallet-stone 16 integral with inertial mass 1.

Thus, resonator 100 includes a stopping device with an entry pallet PE and an exit pallet PS, each able, during oscillation of resonator 100, to cooperate with escape wheel 20. These entry and exit pallets PE and PS can be distinct, or form a one-piece assembly, each is arranged to be secured to inertial mass 1, and the distal end of each pallet PE, PS is arranged to cooperate with teeth 22 of wheel 20. Each pallet PE, PS includes a mechanical pallet-stone 16 arranged for mechanical contact with teeth 22, and this mechanical pallet-stone 16 advantageously but not necessarily, ends in an impulse face at the distal end of the pallet concerned, on the side of escape wheel 20.

According to the invention, at least one escape wheel 20 includes at least one magnet 23 at the end of each tooth 22. And oscillator 300 includes a first magnetic arrangement 30 for entry pallet PE and a second magnetic arrangement 30 for exit pallet PS, which are not necessarily identical, as will be seen below. Each magnetic arrangement 30 is arranged to be placed on a pallet, or forms an integral part of a pallet, on at least an upper flange 15 and/or a lower flange 17, surrounding mechanical pallet-stone 16, and respectively arranged above or below escape wheel 20; these arrangements above and below refer to the direction of axis of oscillation OR of resonator 100, and of axis of rotation OE of escape wheel 20, which is parallel thereto.

In short, an entry pallet PE or an exit pallet PS includes a mechanical pallet-stone 16, arranged to cooperate with teeth 22 of wheel 20, and a magnetic arrangement 30 whose magnetic field effect is in superposition with the potential mechanical interaction surfaces of mechanical pallet-stone 16. This magnetic arrangement 30 can be made on different surfaces, particularly surfaces of mechanical pallet-stone 16, more particularly at the edge of or beyond the area of mechanical interaction with teeth 22 of wheel 20. More particularly, at least one such magnetic arrangement 30 is positioned under an upper flange 15 and/or on a lower flange 17 of one of the entry or exit pallets PE or PS. More particularly, at least one such magnetic arrangement 30 is positioned under an upper flange 15 and on a lower flange 17 of one of the entry or exit pallets PE or PS. More particularly still, such a magnetic arrangement 30 is positioned under an upper flange 15 and on a lower flange 17 of each of the entry or exit pallets PE or PS.

Figure 4:
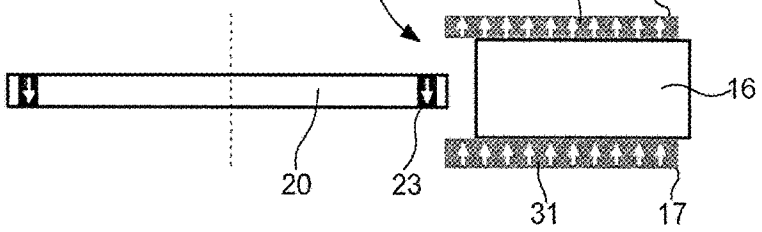
FIG. 4 illustrates a schematic sectional view along a plane perpendicular to the plane of FIGS. 1 to 3, of the repulsive interaction between magnets carried by the escape wheel of FIG. 3, and pallets comprised in the resonator of FIG. 3.

In the variant illustrated by the Figures, resonator 100 is equipped with entry and exit pallets PE and PS including substantially tubular mechanical pallet-stones 16, and above and below which magnets have been added, as visible in FIGS. 3 and 4, to form these magnetic arrangements 30. In a variant, all or part of the magnets may be replaced by at least one continuous magnetized or pixelated surface.

The geometry of the magneto-mechanical escapement is shown in more detail in FIG. 3.

Magnets 23 of escape wheel 20 have a repulsive interaction with the magnets carried by the resonator which are arranged on at least one level, and more particularly on two levels, above and below wheel 20 according to the diagram of FIG. 4.

The sequence illustrated by FIGS. 5 to 10 describes the functions of the escapement.

After a frictionless supplementary arc, on entry pallet PE situated in the left part of the Figure, as seen in FIG. 5, there is unlocking on entry pallet PE, as seen in FIG. 6.

Next, as seen in FIG. 7, escape wheel 20 starts to rotate in the direction of the arrow, under the effect of the maintaining torque, and it transmits its impulse by magnetic repulsion to exit pallet PS situated in the right part of the Figure.

Next, in a particular variant, a mechanical contact, of the impact type, between escape wheel 20 and exit pallet PS dampens rebounds, as seen in FIG. 8. This impact is useful, but not indispensable to the proper operation of the escapement. Indeed, it is possible to make a similar escapement in which no impact occurs. The advantage provided by a small controlled impact like this, is that it dissipates part of the energy and limits the recoil of escape wheel 20. It should also be noted that this impact has the advantage of allowing an acoustic measurement of operation, since, in normal operation, it is then the only audible mechanical contact during operation of the escapement. Limiting the recoil of the wheel provides another advantage, which is the possibility of increasing the number of teeth of escape wheel 20 within the same space.

After this possible mechanical contact, and as seen in FIG. 9, the magnetic repulsion between magnet 23 and escape wheel 20 and the magnetic pallet produces a slight recoil of escape wheel 20, so that the supplementary arc on exit pallet PS, seen in FIG. 10, occurs in a frictionless manner. "Frictionless" means here without any mechanical contact between escape wheel 20 and resonator 100, since evidently friction with the air remains.

A similar sequence occurs on the entry pallet after unlocking of the exit pallet, as illustrated in FIGS. 11 to 16:

FIG. 11: frictionless supplementary arc;
FIG. 12: unlocking on exit pallet PS;
FIG. 13: advance of the escape wheel and impulse on entry pallet PE;
FIG. 14: impact on the entry pallet;
FIG. 15: slight recoil of the escape wheel;
FIG. 16: frictionless supplementary arc.

In order to understand the design of magnetic arrangements 30 of the pallets, which can be called magnetic pallets, it is useful to represent the trajectory T of the preferably cylindrical magnets 23, carried by teeth 22 of escape wheel 20, in the reference frame of resonator 100, as seen in FIG. 17, the curves of which, obtained from the numerical simulation, retrace the exact trajectory T of the centre of a magnet 23 with respect to the corresponding pallet PE or PS.

Considering entry pallet PE, the lowest point to the left of trajectory T in FIG. 17 corresponds to the relative position of FIG. 13 where magnet 23 traverses the upward curve which curves towards the right, before reaching an extremum which corresponds to the impact of FIG. 14; the upward bend towards the left corresponds to the recoil of FIG. 15, the upward trajectory, which, like the pallet itself, and like mechanical pallet-stone 16, is centred on axis of oscillation OR of resonator 10, corresponds to the frictionless supplementary arc of FIG. 16, and this supplementary arc can, in particular, be longer than that illustrated in the Figure, the high position corresponding to FIG. 5, before the downward return with unlocking on the right on entry pallet PE as in FIG. 6. The trajectory as regards exit pallet PS is of course similar. FIG. 17 shows a magnet 23 cooperating in repulsion with a magnetic pad 32, comprised in magnetic arrangement 30, to give it an impulse.

This makes it possible to identify the functional areas of the magnetic pallets according to FIGS. 18 to 21.

On entry pallet PE in FIG. 18, or on exit pallet PS in FIG. 20, the following can be distinguished:

an area of first impulse ZP;
an impact area ZC;
a frictionless supplementary arc area ZA;
an unlocking and second impulse area ZD.

These FIGS. 18 and 20 show that magnetic arrangement 30 necessarily includes a magnetic barrier 31, substantially concentric with pallet PE or PS, and its mechanical pallet-stone 16, about axis of oscillation OR of resonator 10. A certain constant distance exists between the part of trajectory T corresponding to the supplementary arc and this magnetic barrier 31, or each magnetic barrier 31 if there are several.

Each such magnetic barrier 31, together with a magnet 23 of escape wheel 20, makes it possible to avoid any contact, and thus any friction, in normal operation, between tooth 22 and the pallet PE or PS concerned. Naturally, a mechanical contact can occur in case of shock, when the watch is dropped for example, between, on the one hand, mechanical pallet-stone 16 of pallet PE or PS and on the other hand, a tooth 22, which together provide the safety stop function.

Mechanical arrangement 30 includes, in the variants of these same Figures, a complete, non-limiting arrangement, since oscillator 300 according to the invention can operate with all or part of the magnets or magnetized areas described below, provided they include at least magnetic barriers 31;

at least one magnetic barrier 31, including at least one substantially cylindrical magnet about axis of oscillation OR of resonator 10;

at least one magnetic pad 32, preferably supplemented by a magnetic tail portion 33, at least one ferromagnetic or slightly magnetized area 34 for correcting isochronism.

FIG. 25 is a situation diagram which represents, in a similar manner to FIG. 3, a point of entry E and a point of exit S, which are defined by the intersection of a first circle CO centred on the axis of the resonator OR and which are followed by magnetic barriers 31 of entry and exit pallets PE and PS of resonator 3, and a second circle CE, which forms the envelope of escape wheel 20 and is centred on escapement axis OE. Entry pallet PE and exit pallet PS of resonator 3 respectively move at point of entry E and point of exit S. FIG. 25 defines basic directions, which are oriented at tangents to this first circle CO and to this second circle CE, at point of entry E and point of exit S:

D1+: tangent to the entry pallet at the point of entry, directed towards the axis of escapement OE;

D1−: tangent to the entry pallet at the point of entry, in the opposite direction to D1+;

D2+: tangent to wheel 20 at the point of entry, directed in the direction of rotation of wheel 20;

D2−: tangent to wheel 20 at the point of entry, in the opposite direction to D2+;

D3+: tangent to the entry pallet at the point of exit, directed towards axis of escapement OE;

D3−: tangent to the entry pallet at the point of exit, in the opposite direction to D3+;

D4+: tangent to wheel 20 at the point of exit, directed in the direction of rotation of wheel 20;

D4−: tangent to wheel 20 at the point of exit, in the opposite direction to D4+.

The arrangement of this escapement mechanism according to the invention defines one or more functional areas:

a first magnetic barrier area Z1, which is present in all cases, around magnetic barrier 31, or around each magnetic barrier 31 if there are several;

a second self-starting improvement area Z2, around a magnetic pad 32, or around each magnetic pad 32 if there are several;

an area where the impulses are produced, in immediate proximity to or in at least partial superposition with second area Z2, when it exists, and first magnetic barrier area Z1, or each first area Z1;

a third area Z3, which is an area for correction of the isochronism of resonator 100.

Preferably, but not exclusively and as illustrated in the Figures, for entry pallet PE:

the first magnetic barrier area Z1 is an annular sector, centred on the axis of rotation OR of resonator 100, which extends above and/or below the mechanical pallet-stone, over the entire length of the mechanical pallet-stone on which teeth 22 of wheel 20 come to rest during the supplementary arc, as seen in FIG. 19;

the second self-starting improvement area Z2 is an annular sector, centred on axis of rotation OE of wheel 20, which extends substantially in directions D2+ and D2−, and which passes above and/or below the end of the mechanical pallet-stone in order to cover at least the impulse face of the pallet-stone;

the third isochronism correction area Z3 is delimited by first magnetic barrier area Z1 and second self-starting improvement area Z2, and it extends in directions D2− and D1− in order to cover, above and/or below, magnet 23 of tooth 22 of wheel 20 which is resting on the pallet during the supplementary arc.

Likewise, for exit pallet PS:

the first magnetic barrier area Z1 is an annular sector, centred on the axis of rotation OR of resonator 100, which extends above and/or below the mechanical pallet-stone, over the entire length of the mechanical pallet-stone on which teeth 22 of wheel 20 come to rest during the supplementary arc, as seen in FIG. 21;

the second self-starting improvement area Z2 is an annular sector, centred on axis of rotation OE of wheel 20, which extends substantially in directions D4+ and D4−, and which passes above and/or below the end of the mechanical pallet-stone in order to cover at least the impulse face of the pallet-stone;

third isochronism correction area Z3 is delimited by first magnetic barrier area Z1 and second self-starting improvement area Z2, and it extends in directions D4− and D3− in order to cover, above and/or below, magnet 23 of tooth 22 of wheel 20 which is resting on the pallet during the supplementary arc.

First magnetic barrier area Z1 is indispensable and has the function of repelling teeth 22 of escape wheel 20, and thus eliminates mechanical contact so that the supplementary arc occurs without friction. This first magnetic barrier area Z1 can be more or less intense but it must follow an arc of a circle centred on axis of oscillation OR of resonator 10. It is possible to increase the intensity of the barrier if one wishes to avoid mechanical impact between the teeth of escape wheel 20 and mechanical pallet-stones 16 of pallets PE and PS. Or, conversely, it is possible to decrease the intensity of the barrier, if one wishes to minimise the recoil of escape wheel 20 after impact. A mechanism comprising only this magnetic barrier 31 is a variant of a magnetic cylinder escapement, which represents an improvement on European Patent No. EP2889704B1 of NIVAROX-FAR.

Magnetic pad 32 of second self-starting improvement area Z2 is optional. It is advantageously added to reduce the friction between escape wheel 20 and the end of mechanical pallet-stone 16 of pallet PE or PS at the moment of starting by means of magnetic repulsion. This significantly improves the self-starting function. Both the length and shape of magnetic pad 32 are adjusted to optimise the self-starting function.

This magnetic pad 32 also has another effect. When the magnet of escape wheel 20 passes in proximity to the magnetic pad, there is magnetic repulsion, which transmits an impulse to resonator 100 and substantially improves efficiency.

Preferably, magnetic pad 32 includes at least one magnet, and extends substantially perpendicularly to the distal end of magnetic barrier 31 closest to escape wheel 20, and on the cooperating entry side between a magnet 23 and magnetic arrangement 30 of the pallet PE or PS concerned, forming with magnetic barrier 31 an inverted capital letter L. This magnetic pad 32 is not necessarily straight, it can also be slightly curved.

In a non-illustrated variant, it can include, at its distal end opposite magnetic barrier 31, a magnetic lug, on the side opposite the escape wheel, and extending the area where the impulses are produced. More particularly, this magnetic lug is located at the distal end in direction D2− as regards entry pallet PE, and at the distal end in direction D4− as regards exit pallet PS. More particularly still, this magnetic lug extends in direction D1− as regards entry pallet PE, and in direction D3− as regards exit pallet PS. In another non-illustrated variant, magnetic pad 32 extends in direction D2+, respectively D4+.

It should be noted that second self-starting improvement area Z2 is not necessarily identical to the area where the impulses are produced, which means that the impulse can be adjusted without affecting the self-starting function.

As regards entry pallet PE, FIG. 18 shows that magnet 23 of wheel 20 interacts twice with magnetic pad 32: firstly, when magnet 23 moves into first impulse area ZP, it repels magnetic pad 32, and thus transmits a first impulse to resonator 100; then, when magnet 23 moves into unlocking and second impulse area ZD, magnetic pad 32 forms a kind of pass to be crossed, because of the repulsion, and it is the high speed of magnet 23 on its trajectory T that enables it to easily cross this pass. Immediately after crossing the pass, wheel 20 starts to rotate, and a second impulse is then transmitted to resonator 100. As regards exit pallet PS, in the position of first impulse area ZP of FIG. 20, the repulsion between magnet 23 and magnetic pad 32 provides the first impulse to resonator 100; the second impulse is transmitted after crossing the pass into unlocking and second impulse area ZD, in a similar manner to that which occurs on the entry pallet.

In an advantageous variant, magnetic pad 32 is supplemented by a magnetic tail portion 33, which is substantially in its alignment, and on the opposite side with respect to the magnetic barrier, i.e. in direction D2+ with regard to entry pallet PE, and in direction D4+ with regard to exit pallet PS. This magnetic tail portion 33 diverts the force from the axis and tends to drive magnet 23 of escape wheel 20 tangentially, and resists the friction force, it ensures that the repulsion continues to the end of the pallet. This magnetic tail portion 33 is also useful in the overall kinematics, since the magnetic tail portion 33 located on exit pallet PS ensures that the next arm 21 of escape wheel 20 is sufficiently engaged in cooperation with magnetic arrangement 30 of entry pallet PE not to be subjected to the threshold to be overcome during its move to the entry in this area.

Advantageously, the total length of magnetic pad 32 and magnetic tail portion 33 which extends said pad is close to the half-pitch of the ends of teeth 22 on circle CE which is the envelope of the trajectory of escape wheel 20.

In a particular embodiment, magnetic tail portion 33 is arranged in increasing radii from axis of rotation OE of wheel 20 away from said magnetic pad 32.

In a particular embodiment, magnetic tail portion 33 is made in the form of decreasing steps, as seen in FIGS. 18 and 20.

More particularly, the total curvilinear length of magnetic pad 32 is greater than that of magnetic tail portion 33, in order to give a first impulse: to the entry, the pad/tail portion assembly extends further in direction D2− than in direction D2+, and to the exit, the pad/tail portion assembly extends further in direction D4− than in direction D4+.

The addition of such a magnetic pad 32 to magnetic barrier 31 is advantageous for the self-starting function: if there is no magnetic pad, the escape wheel can, in certain configurations, move into mechanical abutment on the distal end of mechanical pallet-stone 16 of pallet PE or PS, and the low torque available in escape wheel 20 is insufficient to overcome the friction. The advantage of magnetic pad 32 is thus to reduce the friction force at the end of mechanical pallet-stone 16 during self-starting, which allows normal self-starting.

The numerical simulation shows that it is possible to further increase efficiency by adding magnets in proximity to the second self-starting improvement area Z2 if necessary.

However, it is no longer necessary to increase efficiency when the nominal amplitude is reached. The quantity of magnets required to optimise the impulses thus depends on the resonator 100 used and its quality factor. If the quality factor is low, more magnets are added. If the quality factor is high, fewer are added.

Since the supplementary arc occurs without friction, except for the first impact, the shape of mechanical pallet-stone 16 can be optimised to minimise losses and also to support self-starting. In particular, the end of the pallets (impulse faces) is optimised to support the self-starting function but the angle chosen no longer allows the impulse to be transmitted in stationary operation. Further, it is not necessary for mechanical pallet-stones 16 of the pallets to be arcs of a circle centred on the axis of rotation of the resonator. An examination of FIGS. 18 to 21 reveals that in mechanical contact area ZC, mechanical pallet-stone 16 of the pallet has been modified, on a profile 301, to minimise the effect of the impact on the balance. The angle of this area must be adjusted so that the contact force support passes through the centre of rotation. It is also possible to incline this contact area, so that the impact transmits energy to inertial mass 1, and consequently improves efficiency. This profile 301 can be an inclined plane, or a tapered hollow profile as in the Figure, and makes it possible to deviate the stress exerted on the pallet downwards in the representation of the Figures, so that the resultant of the two forces forming this stress, and the upward tangential friction force on the pallet, passes through axis of oscillation OR of resonator 10. Likewise, magnetic barrier 31 may include a similar variation of magnetization.

Also optionally but advantageously, small magnets (low interaction) are added in third isochronism correction area Z3, in order to adjust the anisochronism of resonator 100 caused by escapement mechanism 100. The objective is for this induced anisochronism to be compensated by that of resonator 100 so that the total oscillator 300 is perfectly isochronous. The quantity and position of these magnets is adjusted in iterations until the desired effect is obtained. In a variant, it may also be a simple ferromagnetic surface, cooperating weakly with magnets 23 of teeth 22 of escape wheel 20. This third area Z3 extends, from the point of view of teeth 22 of escape wheel 20, upstream of the first magnetic barrier area: in other words, this third area Z3 extends, with respect to axis of oscillation OR of the resonator, beyond magnetic barrier area Z1, and, with respect to axis of rotation OE of escape wheel 20, beyond the distal end of the pallet; when magnetic arrangement 30 includes a magnetic pad 32 defining a second area Z2, and an associated impulse area, third area Z3 is located, with respect to axis of rotation OE of escape wheel 20, beyond second area Z2.

In order to ensure a mechanical safety function, mechanical pallet-stones 16 carried by resonator 100 penetrate the teeth of escape wheel 20 when resonator 100 is in its rest position. The values of depths p1 and p2 are represented in FIG. 22. This Figure shows circle CE which is the envelope of the trajectory of escape wheel 20. Depths p1 and p2, measured from radial lines from axis of oscillation OR of resonator 10, are required for safety reasons, since they prevent any unrestricted rotation of escape wheel 30 when the barrel is completely discharged. For example, a depth value of 40 micrometres ensures this safety function, while absorbing the errors or simply the effect of manufacturing tolerances on the distance of centres between axis of oscillation OR of resonator 10 and axis OE of escape wheel 20.

Given depths p1 and p2, upon starting, the torque applied to escape wheel 20 must be sufficient to push resonator 100 out of its rest position so that the teeth can pass. This can make the self-starting function difficult when the resonator is mounted on a flexure bearing. The addition of magnetic pads 32 to the pallets considerably improves the self-starting function for two reasons. Firstly, the magnetic repulsion has the effect of reducing friction between the teeth and the end of the pallets. On the other hand, this repulsion shifts the rest position of the resonator on the appropriate side so that the tooth can pass. As a result, the oscillator is self-starting over most of the useful torque range.

The effect of the magnets of third isochronism correction area Z3 is to produce a low disturbance of inertial mass 1, in order to adjust the anisochronism of the escapement, to achieve compensation with the anisochronism of resonator 100. This anisochronism correction is not indispensable but can prove advantageous depending upon the type of resonator used.

To make this ferromagnetic or weakly magnetized area 34, instead of arranging magnet pixels in a regular manner as in the anisochronism corrector of FIGS. 1 to 22, it is possible to envisage a variant wherein there is arranged in third area Z3 a very thin continuous magnet layer whose thickness is adjusted by laser or otherwise.

Another variant is presented in FIG. 23 in which there are only two small protrusions 341 on magnetic barrier 31, in third area Z3, which are sufficient to produce the disturbance required for the anisochronism correction.

Yet another variant, in which the anisochronism corrector is arranged only on entry pallet PE, is shown in FIG. 24. It is also possible to place the anisochronism corrector on exit pallet PS.

In another variant, the anisochronism corrector can be placed only on the magnetic pallets of upper flange 15, or only on the magnetic pallets of lower flange 17.

It is also possible to envisage a variant in which anisochronism can be adjusted by varying the distance between the magnets of upper third area Z3 and the magnets of lower third area Z3, which has the effect of varying the intensity of the magnetic field experienced by magnets 23 of escape wheel 20 when they are in third area Z3.

In a variant, third area Z3 contains a sacrificial excess of iron or of magnets, this sacrificial excess is arranged to be at least partly selectively removed according to the result of measurement of the anisochronism of the complete oscillator 300, in order to restore its isochronism.

More particularly, magnetic arrangement 30 is made with a surplus of magnet pixels in third area Z3, the excess magnets can then be removed by selective laser ablation once anisochronism has been measured.

In the variant including a ferromagnetic plate of variable thickness in third area Z3, the interaction occurs in attraction rather than in repulsion.

The invention can thus be achieved in various configurations, but always with a first magnetic barrier area Z1, and in particular but not exclusively:

- a first magnetic barrier area Z1 and a second self-starting improvement area Z3, with only one magnetic pad 32;
- a first magnetic barrier area Z1 and a second self-starting improvement area Z3, with a magnetic pad 32 and a magnetic tail portion 33;
- a first magnetic barrier area Z1 and a third isochronism correction area Z3;
- a first magnetic barrier area Z1, a second self-starting improvement area Z2, and a third isochronism correction area Z3, with only one magnetic pad 32,
- a first magnetic barrier area Z1 and a second self-starting improvement area Z2, and a third isochronism correction area Z3, with a magnetic pad 32 and a magnetic tail portion 33.

It is naturally possible to make a technical reversal of the invention as described above, which consists in placing individual magnets on the pallets of resonator 100, and to arrange more complicated magnetic structure son escape wheel 20, in order to produce the same magnetic barrier effects, magnetic pad, impulse and anisochronism corrector explained above.

It is noted that the aforementioned and illustrated versions, with isolated magnets on the escape wheel, have the advantage of minimising the inertia of escape wheel 20. This is important in order to ensure proper operation of the escapement when oscillator 300 is subjected to external accelerations, which is common during normal use of a watch, and to ensure excellent resistance during wear.

The invention concerns a timepiece movement 500 including at least one such oscillator 300.

The invention also concerns a watch 1000 comprising at least one such movement 500 and/or one such oscillator 300.

The invention claimed is:

1. A timepiece oscillator, comprising:

at least one resonator, with an inertial mass returned by elastic return means with respect to a fixed structure, said resonator oscillating about an axis of oscillation, said inertial mass carrying an entry pallet and an exit pallet;

an escapement mechanism including an escape wheel arranged to rotate about an axis of rotation and including end teeth, each arranged to cooperate with said entry pallet or with said exit pallet to maintain the oscillation of said resonator, wherein said escapement mechanism is a magneto-mechanical escapement mechanism and said escape wheel includes at least one magnet at the end of each said tooth, said teeth being arranged to act alternately with said entry and exit pallets, and said entry pallet includes a first magnetic arrangement, said exit pallet includes a second magnetic arrangement, and said first magnetic arrangement and said second magnetic arrangement each include an annular sector, centered on said axis of oscillation of said resonator, and defining a first magnetic barrier area, which extends above and/or below said mechanical pallet-stone of said entry pallet or of said exit pallet, with reference to the direction of said axis of oscillation, over the entire length of said mechanical pallet-stone able to act as support for said teeth during the supplementary arc, in order to form a magnetic cylinder escapement mechanism.

2. The timepiece oscillator according to claim 1, wherein said first magnetic arrangement and/or said second magnetic arrangement includes, to improve the self-starting function, on said entry pallet and/or on said exit pallet, at least one magnetic pad which includes at least one magnet, and which extends into a second self-starting improvement area, which is an annular sector, centered on said axis of rotation of said wheel, and which extends, as regards said entry pallet, substantially in a tangent direction of entry which is tangent to said wheel and which passes above and/or below said mechanical pallet-stone of said entry pallet, and/or as regards said exit pallet, substantially in an tangent direction of exit which is tangent to said wheel and which passes above and/or below said mechanical pallet-stone of said exit pallet, with reference to the direction of said axis of oscillation, in order to cover at least one impulse face comprised in the end of said entry pallet and/or said exit pallet.

3. The timepiece oscillator according to claim 2, wherein said magnetic pad is extended, from said magnetic barrier and in the direction tangent to said wheel and which goes in the direction of rotation of said wheel, by a magnetic tail portion, which is substantially in the alignment of said magnetic pad, and which is arranged to apply to said magnet of said wheel a force that tends to drive it tangentially, and which is arranged to combat the friction force at the distal end of said pallet on the side of said escape wheel.

4. The timepiece oscillator according to claim 3, wherein said magnetic tail portion is arranged in increasing radii from said axis of rotation of said wheel away from said magnetic pad.

5. The timepiece oscillator according to claim 3, wherein said magnetic tail portion is made in a set of decreasing steps.

6. The timepiece oscillator according to claim 3, wherein the length of said magnetic pad is greater than that of said magnetic tail portion, in order to give a first impulse.

7. The timepiece oscillator according to claim 3, wherein said magnetic pad and said magnetic tail portion are arranged to define a continuous magnetic field on the curvilinear arc on which they are arranged.

8. The timepiece oscillator according to claim 2, wherein the total curvilinear length of said magnetic pad and of any magnetic tail portion which extends said magnetic pad, is close to a half-pitch of the ends of said teeth on a circle which defines the envelope of the trajectory of said teeth of said escape wheel.

9. The timepiece oscillator according to claim 2, wherein said magnetic pad includes, at its distal end opposite to said magnetic barrier, a magnetic lug on the side opposite to said escape wheel, and extending the second self-starting improvement area.

10. The timepiece oscillator according to claim 1, wherein said magnetic arrangement includes a third isochronism correction area which extends, from the point of view of said teeth of said wheel, upstream of said first magnetic barrier area, and, with respect to said axis of rotation of said escape wheel, beyond the distal end of said pallet-stone, at the entry in a tangential direction of entry opposite to the direction of rotation of said wheel and in a radial direction of entry away from the center of rotation of said wheel, and at the exit in a tangential direction of exit opposite to the direction of rotation of said wheel and in a radial direction of exit away from the center of rotation of said wheel, in order to cover, above and/or below said mechanical pallet-stone of said entry pallet or of said exit pallet, with reference to the direction of said axis of oscillation, said magnet of said wheel which is resting on said pallet during the supplementary arc.

11. The timepiece oscillator according to claim 10, wherein said third area is located, with respect to said axis of rotation of said escape wheel, beyond said second self-starting improvement area which delimits, with said first magnetic barrier area, said third isochronism correction area.

12. The timepiece oscillator according to claim 10, wherein said third area is an area of weak magnetic attractive or repulsive interaction with said magnet, of lower magnetic interaction than that of the other areas of magnetic interaction of said magnetic arrangement of which it forms part.

13. The timepiece oscillator according to claim 10, wherein said third area contains iron or magnets which are in magnetic attractive or repulsive interaction with said magnet during the supplementary arc.

14. The timepiece oscillator according to claim 13, wherein the mean quantity of iron or magnet per surface unit is constant in the direction tangent to said wheel, and varies in the direction tangent to said pallet, in order to exhibit a magnetic interaction with said magnet, which is variable according to the angle of said inertial mass with respect to a rest position.

15. The timepiece oscillator according to claim 10, wherein said third area contains a sacrificial excess of iron or of magnets, arranged to be at least partly selectively removed according to the result of measurement of the anisochronism of said complete oscillator, in order to restore the isochronism of said oscillator.

16. The timepiece oscillator according to claim 1, wherein said inertial mass includes at least one balance.

17. A timepiece movement comprising:

at least one of the timepiece oscillator according to claim 1.

18. A watch comprising:

at least one of the movement according to claim 17.

* * * * *